US006543967B1

(12) United States Patent
Marshall

(10) Patent No.: US 6,543,967 B1
(45) Date of Patent: Apr. 8, 2003

(54) STAGGERED REBAR FOR CONCRETE PILINGS

(76) Inventor: Frederick S. Marshall, 1710 Cove Meadow Ct., Arlington, TX (US) 76012

( * ) Notice: Subject to any disclaimer, the term of this patent is extended or adjusted under 35 U.S.C. 154(b) by 0 days.

(21) Appl. No.: 10/081,633

(22) Filed: Feb. 22, 2002

(51) Int. Cl.[7] ..... E02D 5/30

(52) U.S. Cl. ..... 405/252; 405/239; 405/249; 405/256

(58) Field of Search ..... 405/230, 229, 405/231, 233, 239, 249, 251, 252, 256

(56) References Cited

U.S. PATENT DOCUMENTS

| | | | | |
|---|---|---|---|---|
| 2,351,288 A | | 6/1944 | Riches | |
| 2,373,798 A | | 4/1945 | Williams | |
| 2,948,995 A | | 8/1960 | Cogan | |
| 3,238,732 A | | 3/1966 | Aas-Jakobsen | |
| 3,651,653 A | | 3/1972 | Mouton, Jr. | |
| 3,916,635 A | | 11/1975 | Lynch et al. | |
| 5,096,333 A | | 3/1992 | Basssett | |
| 5,228,807 A | * | 7/1993 | Willcox, Jr. | 405/232 |
| 5,288,175 A | * | 2/1994 | Knight | 405/230 |
| 5,320,453 A | * | 6/1994 | Bullivant | 405/239 |
| 5,399,055 A | | 3/1995 | Dutton, Jr. | |
| 5,713,701 A | * | 2/1998 | Marshall | 405/232 |
| 6,012,874 A | * | 1/2000 | Groneck et al. | 405/239 |
| 6,179,526 B1 | * | 1/2001 | Knight et al. | 405/232 |

* cited by examiner

*Primary Examiner*—Frederick L. Lagman
(74) *Attorney, Agent, or Firm*—Bracewell & Patterson, L.L.P.

(57) ABSTRACT

Pilings are installed for leveling a foundation. A first segment is driven into the ground. Then two support rods of varying length are positioned and grouted into a passage running through the segment. The first support rod is one-half of the height of the piling segment, while the second is one and one-half times the height of the piling segment. An additional piling segment is driven on top of the first segment. Support rods which are twice the height of a single segment are positioned and grouted into the passage. This process is repeated until the assembly is the required depth.

13 Claims, 2 Drawing Sheets

STAGGERED REBAR FOR CONCRETE PILINGS

BACKGROUND OF THE INVENTION

1. Field of the Invention

The invention relates generally to a foundation and repair method and apparatus utilizing precast cylinder pilings with metal support rods extending axially through and bonded to the pilings to create a column which is sequentially driven into the earth to form an underground pier.

2. Description of the Related Art

One of the older methods for repairing foundations of buildings having slab-on-ground foundations uses drilled underground piers. Holes are drilled approximately eight to twelve feet in depth and filled with concrete. After the concrete has dried, jacks are placed on top of the pier and the foundation is brought to a level position. The jack is replaced by blocks, shims, and grout. A more recent and less expensive method is the use of driven precast solid concrete cylindrical pile sections, which are approximately one foot in height and six inches in diameter. These sections are driven into the earth one on top of the other to form a column or stack of concrete cylinders. The depth to which the bottom of the pier is driven into the earth depends upon the type of soil and zone of the seasonal moisture change. A cylinder having a larger diameter, or a pile cap, is a placed on top of the previously driven sections. Jacks are placed on top of the pile cap and the foundation is lifted.

The precast pile method relies upon the skin friction with the soil for its strength. It has the advantage of being faster since the concrete does not have to cure and precasting allows better control of concrete strength. A major disadvantage is that the one-foot cylindrical sections may shift and become misaligned during or after the driving operation. Different methods have been proposed for maintaining alignment between sections. However, most do not ensure that there is a least one support rod running completely through an individual piling section.

SUMMARY OF THE INVENTION

The precast pile in this invention is made up of piling segments that are driven into the ground one on top of the other. Each segment has a passageway running axially through each segment that aligns with the passageway of the other piling segment. A short support rod that is one-half the height of the first segment is placed in the passageway of the deepest piling segment. An intermediate support rod that is one and a half times the height of the first segment is placed in the passageway of the deepest segment next to the short support rod. A long support rod is positioned in the first and second passageways so that the long rod abuts with the top of the short support rod. The long support is twice the height of a single segment, so the long rod protrudes above the second piling segment a distance of about one-half the height of the second piling segment.

The method for installing the piling described above is made up of the steps as follows. A first piling segment is driven into the earth. The segment has a passage running axially through it in which a short support rod and an intermediate support rod are placed side-by-side. A second piling segment is driven on top of the first segment. A long support rod is then placed on top of the short support rod inside the passageway. Another long rod is placed on top of the intermediate support rod inside the passageway. The passageways are pre-filled with grout to secure the support rods in the piling segments. Additional pilings are driven into the earth, and additional long rods are placed and grouted into the passage on top of long rods already in place until the pilings are the desired depth. The short and the intermediate rods cause there to be at least one solid rod traversing each piling without a joint at an intersection of piling segments. This interfaces the rods at depths that are not the same as the intersections of the piling segments and helps to provide lateral support and prevent misalignment problems.

DETAILED DESCRIPTION OF THE PREFERRED EMBODIMENTS

Figure 1:
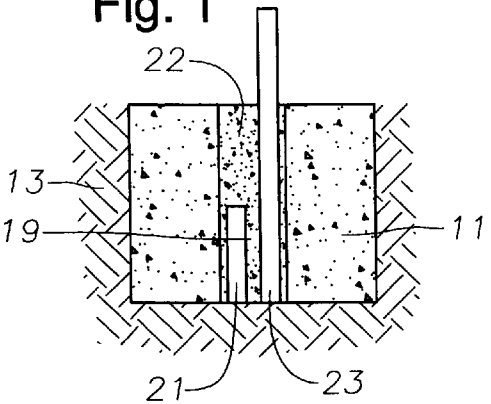
FIG. 1 comprises a cross-sectional view of a first piling segment driven into the ground in accordance with this invention.

FIGS. 1–6 show the progressive steps of the preferred embodiment of the method for installing a pier assembly for leveling a foundation. Referring to FIG. 1, a first piling segment 11 is driven into the ground 13. Piling segment 11 has a substantially flat bottom edge 15 and a substantially flat top edge 17. Piling segment 11 is normally a precast concrete segment having a cylindrical shape. A passage 19 runs axially through piling segment 11 from bottom edge 15 to top edge 17.

After first segment 11 is driven, a grouting material 22 is poured into passage 19. A short support rod 21 is placed in grout 22 in passage 19 until the bottom of short support rod 21 is in contact with ground 13. Short support rod 21 is shorter in height than piling segment 11. In the preferred embodiment, short support rod 21 is approximately one-half the height of piling segment 11. Normally short support rod 21 is an iron rod, which is commonly referred to as "rebar."

An intermediate support rod 23 is placed in grout 22 in passage 19 along side of short support rod 21 until intermediate support rod is in contact with ground 13. Intermediate support rod 23 is taller than piling segment 11 and short than two piling segments 11 stacked one on top of the other. Intermediate support rod 23 is substantially the same material as short support rod 21. In the preferred embodiment, intermediate support rod is approximately one and one-half times the height of piling segment 11. A grouting material 22 is preferably filled to the top of passage 19, as shown, although it could be filled only to a point near the upper end of short support rod 21. Grout material 22 may be any type of cement of adhesive for bonding steel to concrete. Once cured, grout 22 secures support rods 21 and 23 into passage 19.

Figure 2:
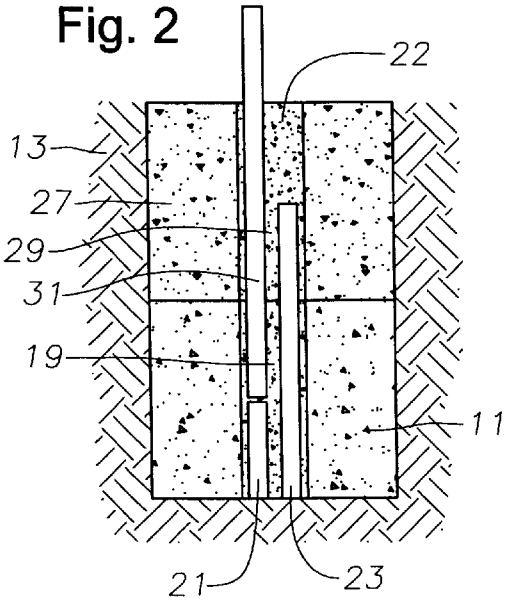
FIG. 2 comprises a cross-sectional view of a second piling segment driven into the ground in accordance with this invention.

Referring to FIG. 2, a second piling segment 27 is driven into ground 13 on top of piling segment 11. Normally segment 27 is driven in before grout 22 cures in passage 19. Segment 27 is a precast concrete cylinder having substantially the same shape and dimensions as piling segment 11. Passage 29 aligns with passage 19 when segment 27 is placed on top of segment 11. Intermediate support rod 23 extends from the top of piling segment 11 into passage 29, for about one-half of the height of piling segment 27. Intermediate rod 23 provides a means for maintaining the alignment of passages 19 and 29 while piling 27 is driven into ground 13. Grout 22 is placed in passage 29. A long support rod 31 is placed in grout 22 in passage 29, so that the bottom end of long rod 31 abuts with the top end of short rod 21, forming a joint 33. Any grout 22 in passage 19 above short support rod 21 must still be viscous to enable long support rod 31 to be installed. In the preferred embodiment, long rod 31 is substantially the same material as rods 21 and 23, and is approximately twice the height of piling segment 11.

Grouting material 22 also fills any remaining area of passage 19 that is not taken up by rods 21, 23, and 31. Once cured, grout 22 secures rod 31 to piling segment 11. Grout 22 also fills the area of passage 29 around rods 23 and 31 at least up to a level below the top end of intermediate rod 23. Grout 22 could be filled to the top of passage 29, as shown. Rods 23 and 31 prevent misalignment between piling segments 11 and 27 when other piling segments are driven into the ground on top of segments 11 and 27, by stopping any horizontal slippage at the level in which segments 11 and 27 are in contact.

Figure 3:
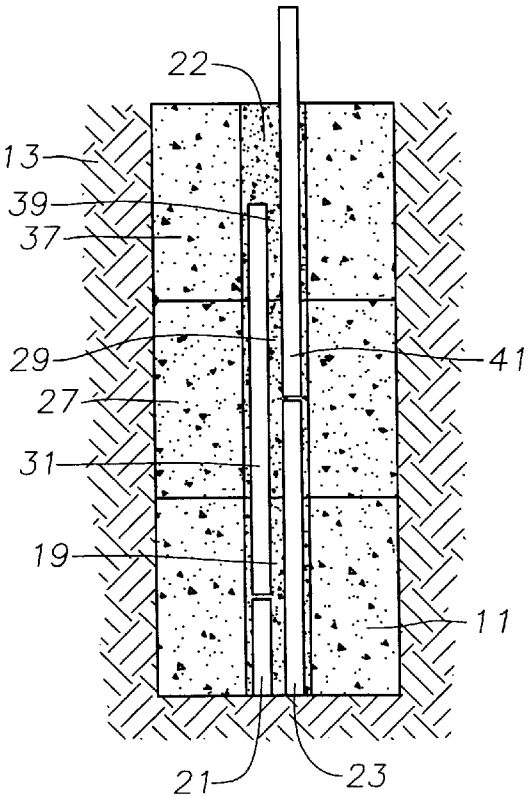
FIG. 3 comprises a cross-sectional view of a third piling segment driven into the ground in accordance with this invention.

Referring to FIG. 3, a third piling segment 37 is driven into ground 13 on top of piling segment 27. Segment 37 is a precast concrete cylinder having substantially the same shape and dimensions as piling segments 11 and 27. Passage 39 aligns with passages 19 and 29 when segment 37 is placed on top of segment 27. Grout 22 is placed in passage 39. Long support rod 31 extends from the top of piling segment 27 into passage 39. In the preferred embodiment long support rod 31 extends into passage 39 for about one-half of the height of segment 37. Long support rod 31 provides a means for maintaining the alignment of passages 19, 29, and 39 while piling 37 is driven into ground 13. A long support rod 41 is placed into passage 39, so that the bottom end of long rod 41 is in contact with the top end of intermediate rod 23. In the preferred embodiment, long rod 41 is substantially the same material as rods 21, 23, and 31. In the preferred embodiment, long rod 41, like rod 31, is approximately twice the height of piling segment 11 (or 27, or 37).

Grouting material 22 fills the remaining area of passage 29 that is not taken up by rods 23, 31 and 41. Grout 22 secures rod 41 to piling segment 27 and also fills the area of passage 39 around rods 31 and 41 at least up to a level below the top end of long rod 31.

Rods 31 and 41 prevent misalignment between piling segments 27 and 37 when other piling segments are driven into the ground on top of segments 27 and 37, by stopping any horizontal slippage at the level in which segments 27 and 37 are in contact. Furthermore, long rod 31 runs from approximately halfway in segment 11, through segment 27, to approximately halfway into segment 37, therefore providing further resistance to segments 11, 27, and 37 shifting out of alignment.

Figure 4:
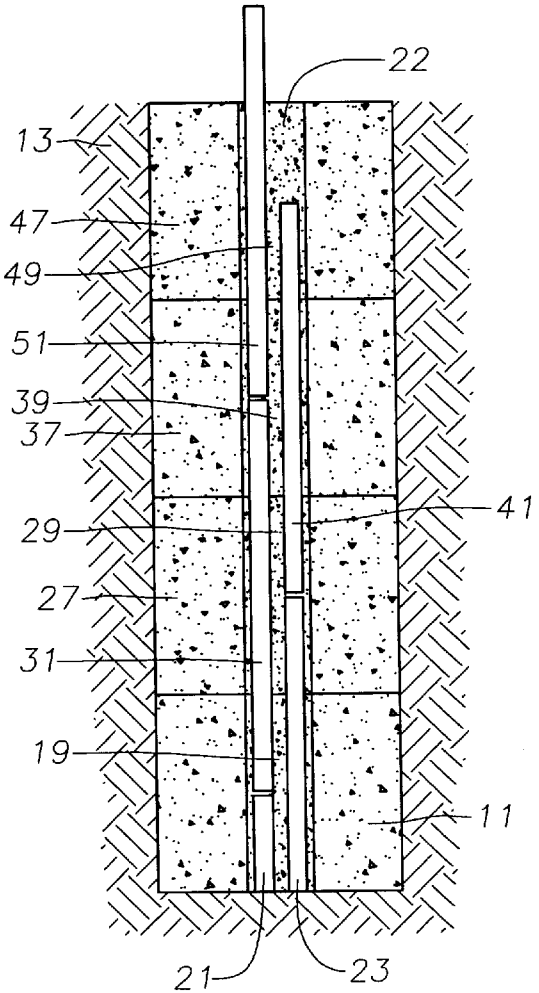
FIG. 4 comprises a cross-sectional view of a fourth piling segment driven into the ground in accordance with this invention.

Referring to FIG. 4, a fourth piling segment 47 is driven into ground 13 on top of piling segment 37. Segment 47 is a precast concrete cylinder having substantially the same shape and dimensions as piling segments 11, 27, and 37. Passage 49 aligns with passages 19, 29, and 39 when segment 47 is placed on top of segment 37. Grout 22 is placed in passage 49 and any remaining part of lower passage 39. Long support rod 41 extends from the top of piling segment 37 into passage 49. In the preferred embodiment long support rod 41 extends into passage 49 for about one-half of the height of segment 47. Long support rod 41 in conjunction with the previously installed support rods provides a means for maintaining the alignment of passages 19, 29, 39, and 49 while piling 47 is driven into ground 13. A long support rod 51 is placed into passage 49, so that the bottom end of long rod 51 is in contact with the top end of long rod 31. In the preferred embodiment, long rod 51 is substantially the same material as rods 21, 23, 31, and 41. In the preferred embodiment, long rod 51, like rods 31 and 41, is approximately twice the height of piling segment 11, 27, 37, or 47.

Rods 41 and 51 prevent misalignment between piling segments 37 and 47 when other piling segments are driven into the ground on top of segments 37 and 47, by stopping any horizontal slippage at the level in which segments 37 and 47 are in contact. Furthermore, long rod 41 runs from approximately halfway in segment 27, through segment 37, to approximately half way into segment 47, therefore providing further resistance to segments 27, 37, and 47 shifting out of alignment.

Figure 5:
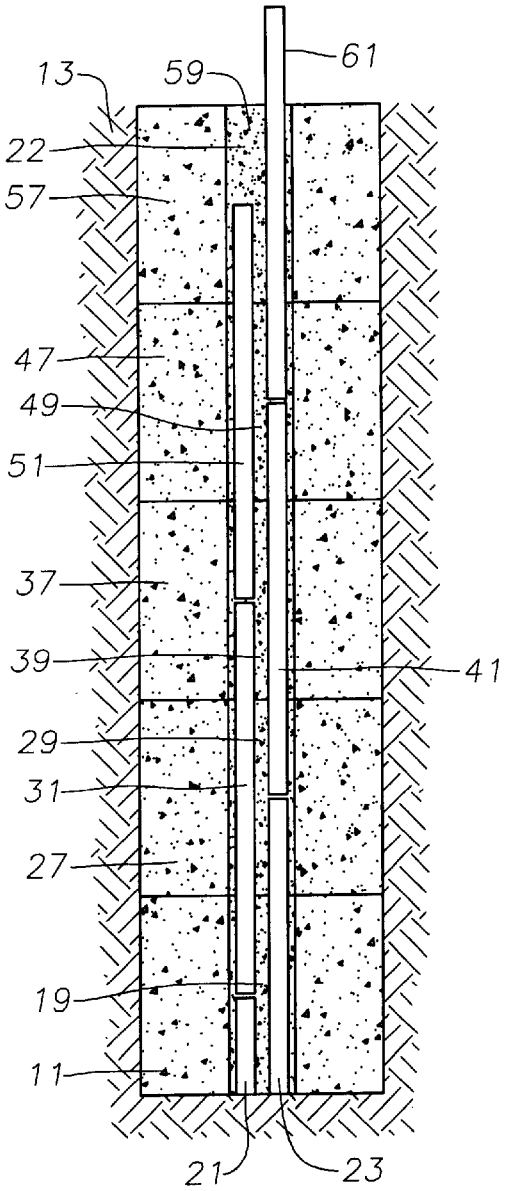
FIG. 5 comprises a cross-sectional view of a fifth piling segment driven into the ground in accordance with this invention.

Referring to FIG. 5, a fifth piling segment 57 is driven into ground 13 on top of piling segment 47. Segment 57 is also a precast concrete cylinder having substantially the same shape and dimensions as piling segments 11, 27, 37, and 47. Passage 59 aligns with passages 19, 29, 39, and 49 when segment 57 is placed on top of segment 47. Long support rod 51 extends from the top of piling segment 47 into passage 59. In the preferred embodiment long support rod 51 extends into passage 59 for about one-half of the height of segment 57. Long support rod 51 in conjunction with the previously installed support rods provides a means for maintaining the alignment of passages 19, 29, 39, 49, and 59 while piling 57 is driven into ground 13. A long support rod 61 is placed into passage 59, so that the bottom end of long rod 61 is in contact with the top end of long rod 41. In the preferred embodiment, long rod 61 is substantially the same material as rods 21, 23, 31, 41, and 51. In the preferred embodiment, long rod 61, like rods 31,41, and 51, is approximately twice the height of piling segment 11, 27, 37, 47, or 57.

Grouting material 22 fills the remaining area of passage 49 located around rods 31, 41, 51, and 61. Grout 22 secures rod 61 to piling segment 47 and fills any remaining area of passage 59 around rods 51 and 61 at least up to a level below the top end of long rod 51.

Rods 51 and 61 prevent misalignment between piling segments 47 and 57 when other piling segments are driven into the ground on top of segments 47 and 57, by stopping any horizontal slippage at the level in which segments 47 and 57 are in contact. Furthermore, long rod 51 runs from approximately half way in segment 37, through segment 47, to approximately half way into segment 57, therefore providing further resistance to segments 37, 47, and 57 shifting out of alignment.

Figure 6:
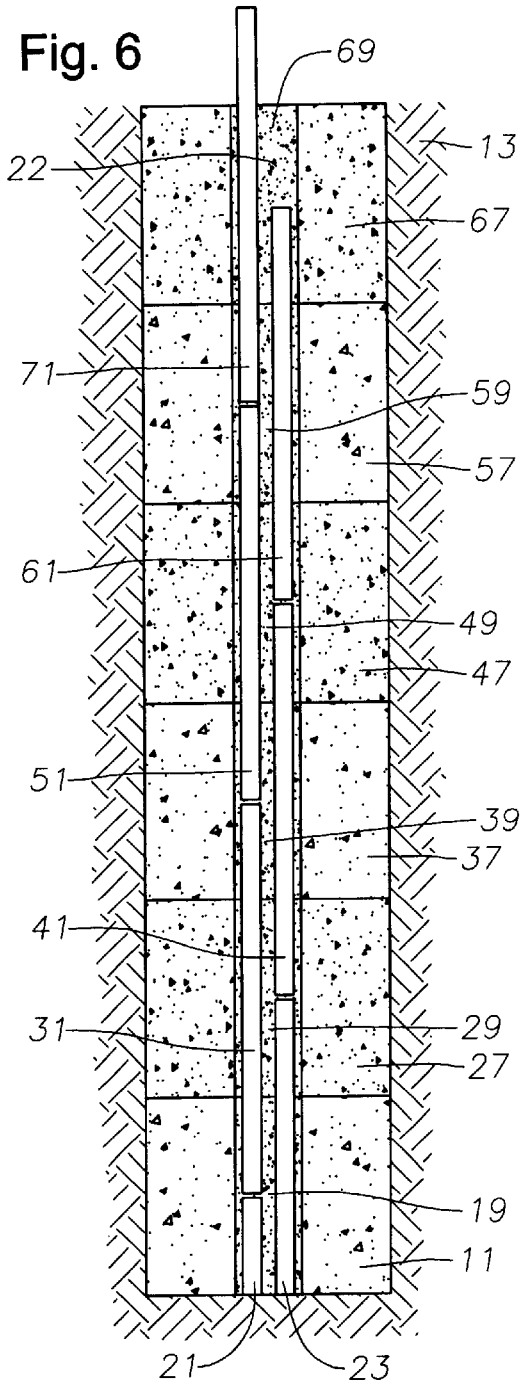
FIG. 6 comprises a cross-sectional view of a sixth piling segment driven into the ground in accordance with this invention.

Referring to FIG. 6, a sixth piling segment 67 is driven into ground 13 on top of piling segment 57. Segment 67 is also a precast concrete cylinder having substantially the same shape and dimensions as piling segments 11, 27, 37, 47 and 57. Passage 69 aligns with passages 19, 29, 39, 49 and 59 when segment 67 is placed on top of segment 57. Long support rod 61 extends from the top of piling segment 57 into passage 69. In the preferred embodiment long support rod 61 extends into passage 69 for about one-half of the height of segment 67. Long support rod 61 in conjunction with the previously installed support rods provides a means for maintaining the alignment of passages 19, 29, 39, 49, 59, and 69 while piling 67 is driven into ground 13. A long support rod 71 is placed into passage 69, so that the bottom end of long rod 71 is in contact with the top end of long rod 51. In the preferred embodiment, long rod 71 is substantially the same material as rods 21, 23, 31, 41, 51, and 61. In the preferred embodiment, long rod 71, like rods 31, 41, 51, and 61, is approximately twice the height of piling segment 11, 27, 37, 47, 57, or 67.

Grouting material 22 is poured into passage 69 and flows into any remaining space in passage 59. Grout 22 fills the remaining area of passage 59 located around rods 31, 41, 51, 61, and 71. Grout 22 secures rod 71 to piling segment 57 and also fills the area of passage 69 around rods 61 and 71 up at least to a level below the top end of long rod 61.

Rods 61 and 71 prevent misalignment between piling segments 57 and 67 when other piling segments are driven into the ground on top of segments 57 and 67, by stopping any horizontal slippage at the level in which segments 57 and 67 are in contact. Furthermore, long rod 61 runs from approximately halfway in segment 47, through segment 57, to approximately halfway into segment 67, therefore providing further resistance to segments 47, 57, and 67 shifting out of alignment.

Figure 7:
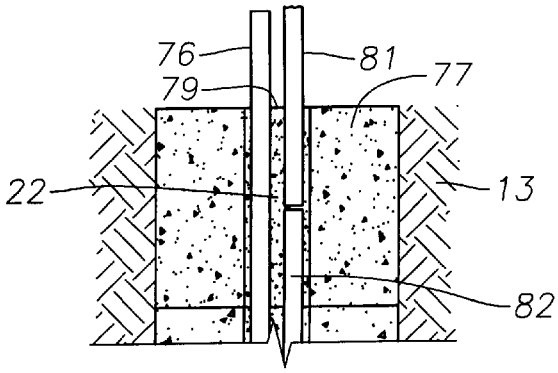
FIG. 7 comprises a cross-sectional view of a top piling segment driven into the ground in accordance with this invention.

Additional piling segments are driven into ground 13 on top of the segment 11, 17, 27, 37, 47, 57, and 67, and additional long rods are added, until the piling assembly reaches the desired depth, based upon the ground conditions. When the piling assembly reaches the desired depth, then the piling assembly needs to be prepared to have a pile cap (not shown) placed above the piling assembly. Referring to FIG. 7, final long rod 76 extends up from a top piling segment 77, which has been driven into ground 13 on top of piling segments 11, 17, 27, 37, 47, 57, 67, and any additional segments needed to reach the desired depth. Final long rod 76 had been placed and grouted into the top piling segment passage 79 in the same manner as described above. A top rod 81 is placed into passage 79 so that the bottom end of top rod 81 is in contact with the top end of a second to final rod 82. Top rod 81 is long enough so that it extends past the top of top piling segment 77. Top rod 81 and final long rod 76 provide a guide for aligning and placing the pile cap (not shown) onto the pile assembly. Prior to installing rod 81, grout 22 is poured into passage 79 to a level substantially even with the top surface of top piling segment 77.

With a piling assembly made in accordance with this method, the support rods are staggered in such manner that prevents the pilings from sliding out of alignment. Each interface between two piling segments is stabilized by solid portions (no joints) of the support rods, which are grouted into the passages. A piling segment should not slide or shear across the surface of another piling segment when, in accordance with this method, there are no joints located at the same level as the piling segment interface. There is only one interface between upper and lower rods located between each segment interface.

Further, it will also be apparent to those skilled in the art that modifications, changes and substitutions may be made to the invention in the foregoing disclosure. Accordingly, it is appropriate that the appended claims be construed broadly and in the manner consistent with the spirit and scope of the invention herein. For example, the same results and advantages would be realized if short support rod 21 were two-thirds the height of piling segment 11 and intermediate support rod were one and two-thirds the height of piling segment 11.

What is claimed is:

1. A piling assembly, comprising:

a first and second piling segments for providing support to the foundation that is being repaired;

a passageway running through each of the piling segments from an upper surface to a lower surface of each segment, the passageway in the first segment aligning with the passageway in the second piling segment;

a short support rod located in the passageway of the first piling segment that is shorter in height than the first piling segment, for helping to prevent lateral movements of the piling segments;

an intermediate support rod located in the passageway of the first piling segment that is taller than the first piling segment but shorter than a combine height of the first and the second piling segments, so that an upper end of the intermediate support rod is halfway between the upper and lower surfaces of the second piling segment; and a long support rod having a lower end located in the passageway of the first piling segment and extending upward from the upper end of the short support rod and above the upper surface of the second piling segment for a distance at least one-half the height of the second piling segment.

2. The piling assembly of claim 1, wherein:

the segments are driven one on top of the other, with the lower surface of the segment on top in contact with the upper surface of the segment on bottom.

3. The piling assembly of claim 1, further providing that the passageway running through each of the segments is located substantially along the centerline of each of the segments.

4. The piling assembly of claim 1, further providing that:

the upper end of the short support rod abuts a lower end of the long support rod; and the upper end of the intermediate support rod abuts a lower end of the long support rod.

5. The piling assembly of claim 1, comprising:

a third piling segment driven on top of the second piling segment, the thrid piling segment having a passageway running there through; and a long support rod having a lower end in the second piling segment and an upper end protruding above the third piling segment a distance at least one-half the height of the third piling segment.

6. The piling assembly of claim 1, further providing that:

the short support rod is substantially one-half the height of each piling segment;

the intermediate support rod is substantially one and one-half the height of each piling segment; and the long support rod is substantially twice the height of each piling segment.

7. The piling assembly of claim 1, further comprising a grout filled in the passageway around the rods.

8. A method for installing a piling comprising the following steps:

(a) driving into the earth a first piling segment having a first passageway there through;

(b) placing a short and an intermediate length support rod into the first passageway, wherein the short support is shorter than the first piling segment, and wherein the intermediate support rod is taller than the first segment;

(c) driving a second piling segment into the earth on top of the first piling segment, the second piling segment having a second passageway; and (d) placing long support rods into the first and second passageways so that the lower end of one of the long support rods abuts the upper end of the short rod, the lower end of another one of the long support rods abuts the upper end of the intermediate rod, the long support rods being greater in length than the intermediate rod.

9. The method for installing a piling in claim 8, further comprising:

repeating steps (c) and (d) with additional piling segments until the desired depth is reached.

10. The method for installing a piling in claim 8, further providing that in step (b) the short support and the intermediate support rods are placed in the first and second passageways until the bottoms of both rods are at the same depth as the lower surface of the first segment.

11. The method for installing a piling in claim 8, wherein segments are substantially equal in height, the short rod is approximately one-half the height of the segments, the intermediate rod is approximately one and one-half times the height of the segment, and the long rod is approximately twice the height of the segment.

12. The method for installing a piling in claim 8, wherein:

step (b) further comprises placing grout in the first passageway; and step (d) further comprises placing grout in the second passageway.

13. A method for installing a piling comprising the following steps:

(a) driving into the earth a first piling segment having a first passageway there through;

(b) placing grout in the first passageway and inserting a short and an intermediate length support rod into the first passageway until the bottom of both rods are at the same depth as the lower surface of the first segment, wherein the short support is one-half the height of the first piling segment, and wherein the intermediate support rod is one and one-half times the height of the first segment;

(c) driving a second piling segment into the earth on top of the first piling segment, the second piling segment being equal in height to the first segment, the second piling segment having a second passageway;

(d) placing grout in the passageway and inserting long support rods into the first and second passageways so that the lower end of one of the long support rods abuts the upper end of the short rod, the long support rods being twice the height of the segments; and (e) repeating steps (c) and (d) with additional pilings until the desired depth is reached.

* * * * *